US005741122A

United States Patent [19]

Yokono et al.

[11] Patent Number: 5,741,122

[45] Date of Patent: Apr. 21, 1998

[54] VARIABLE DISPLACEMENT COMPRESSOR HAVING A SPOOL WITH A COATING LAYER

[75] Inventors: Tomohiko Yokono; Masahiro Kawaguchi; Koji Kawamura; Shinichi Ogura; Masanori Sonobe, all of Kariya, Japan

[73] Assignee: Kabushiki Kaisha Toyoda Jidoshokki Seisakusho, Kariya, Japan

[21] Appl. No.: 625,360

[22] Filed: Apr. 1, 1996

[30] Foreign Application Priority Data

Mar. 30, 1995 [JP] Japan ..... 7-073666

[51] Int. Cl.[6] ..... F04B 1/26

[52] U.S. Cl. ..... 417/222.2

[58] Field of Search ..... 417/222.2

[56] References Cited

U.S. PATENT DOCUMENTS

| | | | |
|---|---|---|---|
| 4,519,119 | 5/1985 | Nakayama et al. | 29/156.5 R |
| 5,363,182 | 11/1994 | Kuribayashi et al. | 355/299 |

FOREIGN PATENT DOCUMENTS

| | | |
|---|---|---|
| 0616128 | 9/1994 | European Pat. Off. . |
| 0628722 | 12/1994 | European Pat. Off. . |
| 628722 | 3/1997 | European Pat. Off. . |
| 3217669 | 4/1991 | Japan . |
| 6346845 | 12/1994 | Japan . |

OTHER PUBLICATIONS

"Modern Plastics", Richard E. Fifoot, pp. 19 and 20 Jun. 1991.

English language translation (2 pages) of German Publication, *Maschinenelemente*, published 1975; Table 5/19 of p. 126 and paragraph b) of p. 127.

*Primary Examiner*—Charles G. Freay

*Attorney, Agent, or Firm*—Brooks Haidt Haffner & Delahunty

[57] ABSTRACT

A compressor has a housing body, a drive shaft, a swash plate, and a piston. The swash plate converts rotation of the drive shaft to reciprocating movement of the piston in a cylinder bore. The piston compresses gas supplied to the cylinder bore from an external circuit via a suction chamber and discharges the compressed gas to a discharge chamber. The swash plate is tiltable with respect to a plane perpendicular to the longitudinal axis of the drive shaft according to differential pressure between the crank chamber and the suction chamber. The swash plate controls the displacement of the compressor based on the inclination thereof. A spool is movable longitudinally between a first position and a second position in response to the inclination of the swash plate. The spool connects the external circuit with the suction chamber in the first position and disconnects the external circuit from the suction chamber in the second position. The housing body has a surface slidably engaged by the spool. A coating layer is provided on at least one of the spool and the slide surface to reduce frictional resistance occurring due to the sliding movement of the spool on the slide surface. A second coating layer is provided on an end surface of the spool to lubricate and thereby reduce frictional resistance with the housing surface along the periphery of the suction passage leading into the shutter chamber occurring due to rotation of the spool, and also to improve the seal between the end surface of the spool and the housing when in the second position closing off the suction passage.

29 Claims, 3 Drawing Sheets

VARIABLE DISPLACEMENT COMPRESSOR HAVING A SPOOL WITH A COATING LAYER

BACKGROUND OF THE INVENTION

1. Field of the Invention

The present invention relates to a variable displacement compressor which controls the inclined angle of a swash plate based on the difference between the pressure in the crank chamber and the suction pressure to control the discharge displacement. More specifically, this invention relates to a variable displacement compressor which can stop the circulation of the gas through the compressor and an external circuit when the inclined angle of the swash plate is minimum.

2. Description of the Related Art

In general, compressors are mounted in vehicles to supply compressed refrigerant gas to the vehicle's air conditioning system. To maintain the air temperature inside the vehicle at a level comfortable for the vehicle's passengers, it is important to use a compressor having a controllable displacement. One known compressor of this type controls the inclination of a swash plate, tiltably supported on a drive shaft, based on the difference between the pressure in a crank chamber and the suction pressure, and converts the rotational motion of the swash plate to reciprocal linear motion of each piston.

The compressor described above has no electromagnetic clutch for the transmission and blocking of power between an external driving source and the drive shaft of the compressor. The external driving source is coupled directly to the drive shaft. The clutchless structure with the driving source coupled directly to the drive shaft eliminates shocks that would otherwise be produced by the ON/OFF action of such a clutch. When such a compressor is mounted in a vehicle, passenger comfort is improved. The clutchless structure also reduces the overall weight of the cooling system and thus reduces costs.

In such a clutchless system, the compressor runs even when no cooling is needed. With such compressors, it is important that, when cooling is unnecessary, the discharge displacement be reduced as much as possible to prevent the evaporator from frosting. When no cooling is needed or there is a probability of frosting, the circulation of the refrigerant gas through the compressor and its external refrigeration circuit should be stopped. The compressor shown in FIG. 5 is designed to block the flow of gas into a suction chamber 54 from an external refrigeration circuit (not shown) by the use of a spool 50 to stop the circulation of the refrigerant gas.

As shown in FIG. 5, the cylindrical spool 50 is slidably accommodated in a shutter chamber 52 defined in a cylinder block 51. The spool 50 moves along the axis of a drive shaft 56, in accordance with the tilting of a swash plate (not shown) supported by the drive shaft 56. A rear end of the drive shaft 56 is inserted into the spool 50. A ball bearing 57 is positioned between the rear end of the drive shaft 56 and the inner circumferential surface of the spool 50. The rear end of the drive shaft 56 is supported by the ball bearing 57 and the spool 50 in the shutter chamber 52. The compressor has a suction passage 53 connected to the external refrigeration circuit. The suction passage 53 is communicated with the suction chamber 54 through the shutter chamber 52. A positioning surface 55 is defined in the cylinder block 51 between the shutter chamber 52 and the suction chamber 54.

When the swash plate is fully inclined and thus the compressor displacement is maximal, the spool 50 is moved to an open position as shown by the solid lines in FIG. 5, where the spool 50 enables communication between the suction passage 53 and the suction chamber 54. Therefore, the refrigerant gas flows into the suction chamber 54 from the external refrigeration circuit and circulates between the external refrigeration circuit and the compressor. As the swash plate becomes less inclined from this state, the spool 50 moves toward the positioning surface 55. When the inclination of the swash plate is minimal and thus the compressor displacement is minimal, the spool 50 abuts against the positioning surface 55 as shown by the double-dotted lines in FIG. 5. The abutment restricts the movement of the spool 50 toward the positioning surface 55 and positions the spool 50 at a closed position. The spool 50 disconnects the suction passage 53 from the suction chamber 54. Accordingly, the refrigerant gas stops flowing into the suction chamber 54 from the external refrigeration circuit, thereby preventing circulation of the refrigerant gas between the external refrigeration circuit and the compressor.

When moving between the open and closed positions, the spool 50 slides in the axial direction of the shutter chamber 52 with respect to the inner circumferential surface of the shutter chamber 52. In addition, although the rear end of the drive shaft 56 is supported by the ball bearing 57 in a manner such that it is relatively rotatable with respect to the spool 50, the spool 50 is also relatively rotatable with respect to the inner circumferential surface of the shutter chamber 52 in the circumferential direction. For this reason, rotation of the drive shaft 56 may cause the spool 50 to rotate with the shaft 56 and may result in the spool 50 sliding with respect to the inner circumferential surface of the shutter chamber 52 in the circumferential direction. Such sliding causes friction between the spool 50 and the inner circumferential surface of the shutter chamber 52 and prevents smooth movement of the spool 50. Furthermore, when the spool 50 moves to the closed position, the drive shaft 56 may rotate with the spool 50, which is abutted against the positioning surface 55. This may cause friction of the spool 50 and the positioning surface 55.

The refrigerant gas includes a mist-like lubricant. When the compressor is operated, the lubricant flows with the refrigerant gas inside the compressor and circulates in each section of the compressor. However, when the operation of the compressor is stopped, there are cases in which the refrigerant gas inside the compressor coheres and becomes liquefied. Liquefied refrigerant may also flow into the compressor from the external refrigeration circuit. When operation of the compressor is resumed in such a state, the lubricant inside the compressor is washed away by the liquefied refrigerant and is discharged to the external refrigeration circuit along with this liquefied refrigerant. As a result, the amount of lubricant in the compressor decreases. Thus, lubrication in the compressor becomes insufficient. Such insufficient lubrication, when operation of the compressor is resumed, leads to an increase in friction.

Friction heat produced by the rotation of the spool 50, while it is contacting the positioning surface 55, results in a microscopic deformation of the contact area between the spool 50 and the positioning surface 55. This decreases the effectiveness of the seal between the members 50 and 55. Dimensional manufacturing errors of parts such as the spool 50 and the positioning surface 55 may also decrease the seal effectiveness. A decrease in the seal effectiveness between the spool 50 and the positioning surface 55 results in gas flow between the suction passage 53 and the suction chamber 54. This permits some circulation of the refrigerant gas between the external refrigeration circuit and the compressor which may result in frosting.

SUMMARY OF THE INVENTION

Accordingly, it is a primary objective of the present invention to provide a variable displacement compressor which ensures the reducing of friction between parts contacting each other.

Another objective of the present invention is to provide a variable displacement compressor having a blocking member which can securely stops the circulation of refrigerant gas.

To achieve the above objects, the compressor according to the present invention has a housing body, a drive shaft, a swash plate, a piston and a cylinder. The swash plate converts rotation of the drive shaft to reciprocating movement of the piston in the cylinder bore. The piston compresses gas supplied to the cylinder bore from an external circuit via a suction chamber and discharges the compressed gas to a discharge chamber. The swash plate is tiltable with respect to a plane perpendicular to the axis of the drive shaft according to differential pressure between that in the crank chamber and that in the suction chamber. The swash plate controls displacement of the compressor based on the inclination thereof. A member is movable between a first position and a second position in response to the inclination of the swash plate. The member connects the external circuit with the suction chamber in the first position and disconnects the external circuit from the suction chamber in the second position. The housing body has a surface slidably engaged with the member. A coating layer is provided on at least one of the member and the slide surface to reduce the resistance occurring due to the sliding movement of the member on the slide surface.

BRIEF DESCRIPTION OF THE DRAWINGS

The features of the present invention that are believed to be novel are set forth with particularity in the appended claims. The invention, together with objects and advantages thereof, may best be understood by reference to the following description of the presently preferred embodiments together with the accompanying drawings in which:

DETAILED DESCRIPTION OF THE PREFERRED EMBODIMENTS

A compressor according to a first embodiment of the present invention will now be described with reference to FIGS. 1 through 3.

Figure 1:
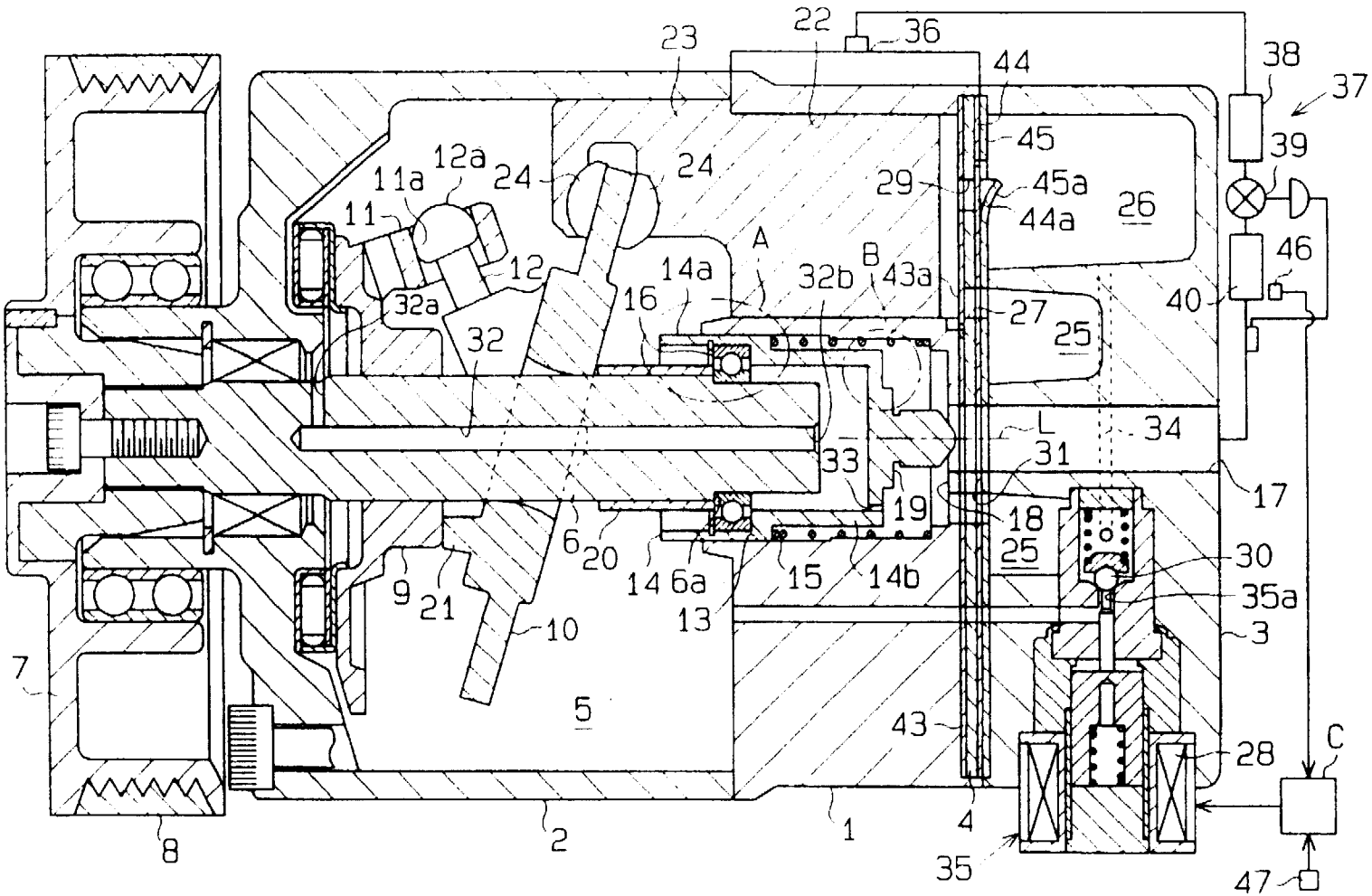
FIG. 1 is a longitudinal cross-sectional view showing a compressor according to a first embodiment of the present invention.

As shown in FIG. 1, a cylinder block 1 made of aluminum or aluminum alloy is provided. A front housing 2 is secured to the front end of the cylinder block 1. A rear housing 3 is secured to the rear end of the cylinder block 1 with a first plate 4, a second plate 43, a third plate 44 and a fourth plate 45 sandwiched between them. The cylinder block 1, the front housing 2 and the rear housing 3 constitute a housing body.

A crank chamber 5 is defined in the front housing 2. A drive shaft 6 is supported rotatably on the front housing 2 and the cylinder block 1. The front end of the drive shaft 6 protrudes outside the crank chamber 5 and is secured to a pulley 7. The pulley 7 is coupled to an engine of a vehicle (not shown) via a belt 8.

A swash plate 10 is supported by the drive shaft 6 in such a way as to be slidable along and tiltable with respect to the axis L of the shaft 6. A pair of guide pins 12 is secured to the swash plate 10. Guide balls 12*a* are formed at the distal ends of the respective guide pins 12. A rotary plate 9 is fixed to the drive shaft 6. The rotary plate 9 has a support arm 11 protruding toward the swash plate 10 (rearward) from the rotary plate 9. A pair of guide holes 11*a* are formed in the arm 11, and the guide balls 12*a* are slidably fitted in the associated guide holes 11*a*.

The cooperation of the arm 11 and the guide pins 12 permits the swash plate 10 to rotate together with the drive shaft 6 and to tilt with respect to the drive shaft 6. The tilting of the swash plate 10 is guided when the guide balls 12*a* slide in the associated guide holes 11*a* and the swash plate 10 slides along the axis L of the drive shaft 6.

A shutter chamber 13 is formed in the center portion of the cylinder block 1, extending along the axis L of the drive shaft 6. A hollow cylindrical spool 14 is accommodated in the shutter chamber 13 in such a way as to be slidable along the axis L of the drive shaft 6. The spool 14 is preferably made of aluminum or aluminum alloy. The spool 14 has a large diameter portion 14*a* and a small diameter portion 14*b* and a step between them. A coil spring 15 is located between the step on the spool 14 and the inner wall of the shutter chamber 13. The coil spring 15 urges the spool 14 toward the swash plate 10.

Figure 2:
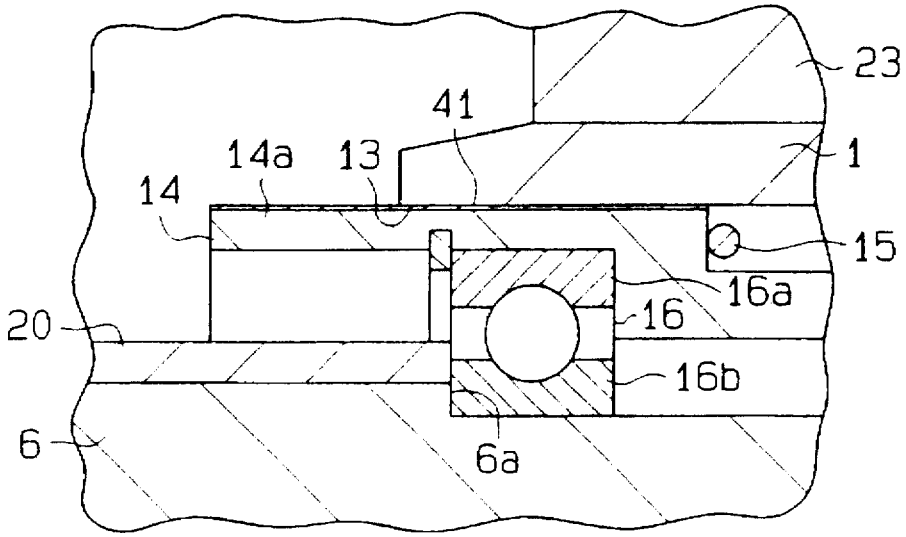
FIG. 2 is an enlarged partial cross-sectional view showing the section encompassed by circle A in FIG. 1.

As shown in FIGS. 1 and 2, the rear end of the drive shaft 6 is inserted in the spool 14. An angular contact ball bearing 16 is located between the rear end of the drive shaft 6 and the inner wall of the large diameter portion 14*a* of the spool 14. The ball bearing 16 receives loads in the radial direction and the thrust direction that are applied to the drive shaft 6. The rear end of the drive shaft 6 is supported by the inner wall of the shutter chamber 13 through the ball bearing 16 and the spool 14. The ball bearing 16 has an outer race 16*a* fixed to the inner wall of the large diameter portion 14*a* and an inner race 16*b*, which is slidable along the axis L of the drive shaft 6. Therefore, the ball bearing 16 moves together with the spool 14 along the axis L of the drive shaft 6.

A step portion 6*a* is formed on the rear outer surface of the drive shaft 6. The engagement of the inner race 16*b* of the ball bearing 16 and this step portion 6*a* inhibits the movement of the ball bearing 16 toward the swash plate 10 (frontward). At the same time, the engagement prohibits the spool 14 from moving toward the swash plate 10.

As shown in FIG. 1, a suction passage 17 is formed in the center portion of the rear housing 3, extending along the axis L of the drive shaft 6. The suction passage 17 communicates with the shutter chamber 13. A positioning surface 18 is formed on the cylinder block 1 between the shutter chamber 13 and the suction passage 17. The rear end face of the spool 14 constitutes a shutter surface 19, which is adapted to abut against the positioning surface 18. As the shutter surface 19 abuts against the positioning surface 18, the movement of the spool 14 in a direction away from the swash plate 10, or in the rearward direction, is restricted and the suction passage 17 is disconnected from the shutter chamber 13.

A pipe 20 is slidably attached to the drive shaft 6 between the swash plate 10 and the ball bearing 16. The front end of the pipe 20 is engagable with the rear end face of the swash plate 10. The rear end of the pipe 20 contacts only the inner race 16b of the ball bearing 16.

As the swash plate 10 moves toward the spool 14, it pushes the pipe 20. The pipe 20 in turn pushes the inner race 16b of the ball bearing 16. As a result, the spool 14 moves toward the positioning surface 18 against the urging force of the spring 15, and the shutter surface 19 of the spool 14 abuts against the positioning surface 18. At this time, the inclination of the swash plate 10 is restricted to be minimized. The minimum inclination of the swash plate 10 corresponds to a position slightly deviated or inclined from a position perpendicular to the axis L.

When the inclination of the swash plate 10 reaches the minimum, the spool 14 comes to a closed position to disconnect the suction passage 17 from the shutter chamber 13. The spool 14 is movable between the closed position and an open position (see FIG. 1) spaced from the closed position, and is positioned in response to the movement of the swash plate 10. As shown in FIG. 1, as a projection 21 of the front face of the swash plate 10 abuts against the rotary plate 9, the swash plate 10 is restricted not to incline beyond a predetermined maximum inclination.

A plurality of cylinder bores 22 are formed in the cylinder block 1 to communicate with the crank chamber 5. Single-headed pistons 23 are retained in the associated cylinder bores 22. The hemispherical portions of a pair of shoes 24 are fitted on each piston 23 in a mutually slidable manner. The swash plate 10 is held between the flat portions of both shoes 24. Accordingly, the undulation of the swash plate 10 caused by the rotation of the drive shaft 6 is transmitted through the shoes 24 to each piston 23, so that each piston 23 reciprocates in the associated cylinder bore 22 in accordance with the inclination of the swash plate 10.

A suction chamber 25 and a discharge chamber 26 are defined in the rear housing 3. Suction ports 27 and discharge ports 29 are formed in the first plate 4. Suction valves 43a are formed on the second plate 43, and discharge valves 44a are formed on the third plate 44. As each piston 23 moves backward, or away from the suction chamber 25, the refrigerant gas in the suction chamber 25 forces the associated suction valve 43a to open and flows into the associated cylinder bore 22 through the associated suction port 27. As each piston 23 moves forward, or toward the discharge chamber 26, the refrigerant gas in the cylinder bores 22 forces the associated discharge valve 44a to open and flows into the discharge chamber 26 through the associated discharge port 29. As each discharge valve 44a abuts against a retainer 45a formed on the fourth plate 45, the degree of opening of the associated discharge valve 44a is restricted.

The suction chamber 25 communicates with the shutter chamber 13 via a communication hole 31. The communication hole 31 is blocked from the suction passage 17 when the shutter surface 19 of the spool 14 abuts against the positioning surface 18. The suction passage 17 forms an inlet to supply the refrigerant gas into the compressor. Therefore, the spool 14 blocks the passage of the refrigerant gas from the suction passage 17 to the suction chamber 25 downstream of that inlet.

A passage 32 is formed in the drive shaft 6. The passage 32 has an inlet 32a open to the crank chamber 5 in the vicinity of the front end of the drive shaft 6, and an outlet 32b open to the interior of the spool 14. A pressure release hole 33 is formed in the rear end face of the spool 14. The hole 33 communicates the interior of the spool 14 with the shutter chamber 13.

A supply passage 34 connects the discharge chamber 26 to the crank chamber 5. An electromagnetic valve 35 is attached to the rear housing 3 and is located midway in the supply passage 34. When the solenoid 28 of the electromagnetic valve 35 is excited, a valve body 30 closes a valve hole 35a. When the solenoid 28 is de-excited, the valve body 30 opens the valve hole 35a. Therefore, the electromagnetic valve 35 selectively opens or closes the supply passage 34 between the discharge chamber 26 and the crank chamber 5.

An external refrigeration circuit 37 connects the suction passage 17 for supplying the refrigerant gas into the suction chamber 25 to the outlet port 36 for discharging the refrigerant gas from the discharge chamber 26. Provided above the external refrigeration circuit 37 are a condenser 38, an expansion valve 39, and an evaporator 40. The expansion valve 39 controls the flow rate of the refrigerant in accordance with a change in gas pressure on the outlet side of the evaporator 40. A temperature sensor 46 is located near the evaporator 40. The temperature sensor 46 detects the temperature in the evaporator 40, and outputs a signal based on the detected temperature to a controller C.

The controller C controls the solenoid 28 of the electromagnetic valve 35 based on the signal from the temperature sensor 46. When the temperature detected by the temperature sensor 46 is equal to or below a predetermined value while an activation switch 47 of the air conditioning system is set on, the controller C de-excites the solenoid 28 to prevent frosting from taking place in the evaporator 40. The controller C de-excites the solenoid 28 when the activation switch 47 is switched off.

As shown in FIG. 2, a fluororesin coating 41 is provided on the outer circumferential surface of the large diameter portion 14a of the spool 14. The fluororesin coating 41 is applied with the aid of blast painting or the like. In the present embodiment, ETFE (copolymer of ethylene and tetrafluoroethylene) is used for the coating 41. The thickness of the coating 41 is preferably 40–60 μm.

Figure 3:
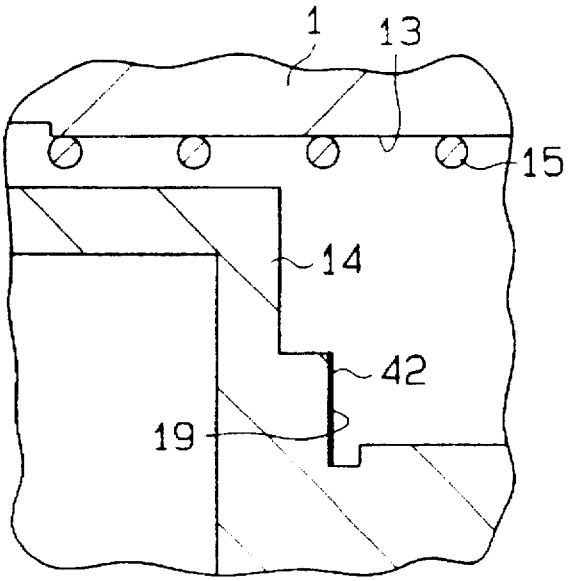
FIG. 3 is an enlarged partial cross-sectional view showing the section encompassed by circle B in FIG. 1.

As shown in FIG. 3, a fluororesin coating 42 is provided on the shutter surface 19 of the spool 14. The fluororesin coating is applied with the aid of blast painting or the like. In the same manner as the coating 41, ETFE is used for the coating 42, and its preferred thickness is 40–60 μm. In FIGS. 2 and 3, the thickness of the coatings 41 and 42 is exaggerated.

The operation of the compressor will now be described.

FIG. 1 shows the solenoid 28 in an excited state in which the supply passage 34 is closed. Therefore, the refrigerant gas under high pressure in the discharge chamber 26 is not supplied to the crank chamber 5. In this situation, the refrigerant gas in the crank chamber 5 simply flows out to the suction chamber 25 via the passage 32 and the pressure release hole 33 so that the pressure in the crank chamber 5 approaches the low pressure in the suction chamber 25, i.e., the suction pressure. As a result, the pressure difference between the crank chamber 5 and the cylinder bores 22 is reduced and the inclination of the swash plate 10 becomes maximized. The discharge displacement of the compressor is thus maximized.

When the gas is discharged with the swash plate 10 kept at the maximum inclination while the cooling load of the compressor becomes lower, the temperature in the evaporator 40 falls to approach the value that may cause frosting. When the temperature detected by the temperature sensor 46 becomes equal to or lower than the predetermined value, the controller C de-excites the solenoid 28. When the solenoid 28 is de-excited, the supply passage 34 is opened to connect the discharge chamber 26 to the crank chamber 5. Consequently, the refrigerant gas under high pressure in the discharge chamber 26 flows into the crank chamber 5 via the supply passage 34, raising the pressure in the crank chamber 5. The difference between the pressure in the crank chamber 5 and the pressure in the cylinder bores 22 therefore increases and the inclination of the swash plate 10 becomes smaller.

As the inclination of the swash plate 10 becomes smaller, the spool 14 is pushed toward the positioning surface 18 with the pipe 20 and the ball bearing 16. When the shutter surface 19 of the spool 14 abuts against the positioning surface 18, the spool 14 blocks the suction passage 17 from the suction chamber 25. Consequently, the refrigerant gas in the external refrigeration circuit 37 does not flow into the suction chamber 25 and the circulation of the refrigerant gas through the compressor and the external refrigeration circuit 37 is stopped.

When the spool 14 abuts against the positioning surface 18, the inclination of the swash plate 10 is minimum. Since the minimum inclination of the swash plate 10 is slightly inclined from a position perpendicular to the axis L, the refrigerant gas is discharged into the discharge chamber 26 from the cylinder bores 22 even when the inclination of the swash plate 10 is minimized. Even when the inclination of the swash plate 10 is minimized, therefore, a pressure difference exists between the discharge chamber 26, the crank chamber 5 and the suction chamber 25. With the inclination of the swash plate 10 at the minimum, therefore, a circulation path circulating gas between the discharge chamber 26, the supply passage 34, the crank chamber 5, the passage 32, the pressure release hole 33, the suction chamber 25, and the cylinder bores 22 is formed in the compressor. The refrigerant gas circulates along this circulation path, and the lubricating oil suspended in the refrigerant gas lubricates the internal parts of the compressor.

When the cooling load of the compressor increases from the above state, it appears as a rise in temperature in the evaporator 40. When the temperature detected by the temperature sensor 46 exceeds the predetermined value, the controller C excites the solenoid 28. When this excitation takes place, the supply passage 34 is closed to disconnect the discharge chamber 26 from the crank chamber 5. Under this situation, the refrigerant gas in the crank chamber 5 flows out to the suction chamber 25 via the passage 32 and the pressure release hole 33, and the pressure in the crank chamber 5 decreases. As a result, the inclination of the swash plate 10 shifts toward its maximum from its minimum.

As the inclination of the swash plate 10 is increased, the spool 14 is gradually separated from the positioning surface 18 by the spring force of the coil spring 15. During this separation, the amount of refrigerant gas that flows into the suction chamber 25 from the suction passage 17 gradually increases. As a result, the amount of the refrigerant gas drawn into the cylinder bores 22 from the suction chamber 25 also increases gradually, and the discharge displacement of the compressor increases gradually.

When the engine stops, the compressor stops running and the solenoid 28 is de-excited. Therefore, the inclination of the swash plate 10 shifts toward the minimum inclination. With the operation of the compressor stopped, the swash plate 10 is held at its minimum inclination.

In the present embodiment, introduction of the refrigerant gas from the external refrigeration circuit 37 to the suction chamber 25 is allowed and prevented, by the spool 14 moving between the open position and the closed position in accordance with the tilting of the swash plate 10. When the spool 14 moves between the open position and the closed position, the spool 14 slides in the axial direction of the shutter chamber 13 with respect to the inner surface of the shutter chamber 13. The rotation of the drive shaft 6 may be transmitted to the spool 14 through the ball bearing 16 and cause slight rotation of the spool 14. In such cases, the spool 14 rotates against the inner surface of the shutter chamber 13.

However, in the present embodiment, a fluororesin coating 41 is provided on the outer surface of the large diameter portion **14*a* of the spool 14, which contacts the inner surface of the shutter chamber 13. Therefore, the friction coefficient of the outer surface of the large diameter portion 14*a* is decreased. This reduces the sliding resistance between the outer surface of the large diameter portion 14*a* and the inner surface of the shutter chamber 13. Accordingly, the spool 14 moves smoothly inside the shutter chamber 13, and prevents increased friction of the spool 14 against the inner surface of the shutter chamber 13. As a result, the durability of the spool 14 is improved. This leads to an increased compressor life. In addition, the smooth movement of the spool 14 allows the swash plate 10** to tilt with less resistance.

when the spool 14 moves to the closed position, there is a possibility that the spool 14 may rotate together with the drive shaft 6, with the spool 14 abutted against the positioning surface 18. However, in the preferred embodiment, the fluororesin coating 42 is provided on the shutter surface 19 of the spool 14, which comes into contact with the positioning surface 18. Thus, this decreases the friction coefficient of the shutter surface 19 and reduces the sliding resistance between the shutter surface 19 and the positioning surface 18. Accordingly, although the spool 14 is rotated while contacting the positioning surface 18, increased friction does not take place between the spool 14 and the positioning surface 18.

When operation of the compressor is resumed after having been stopped, there are times when the lubricant inside the compressor is washed away by liquefied refrigerant and discharged to the external refrigeration circuit. This causes insufficient lubrication inside the compressor. In such cases, the coatings 41, 42, provided on the external circumferential surface of the spool 14 and the shutter surface 19, prevent increased friction.

The coating 42 of the shutter surface 19 of the spool 14 absorbs dimensional manufacturing errors and microscopic deformation of the shutter surface 19 and the positioning surface 18. Thus adhesion between the shutter surface 19 and the positioning surface 18 is improved. This enhances the sealing effectiveness between the shutter surface 19 and the positioning surface 18. As a result, when the spool 14 abuts against the positioning surface 18, the suction passage 17 is positively disconnected from the suction chamber 25. This ensures blockage of the circulation of the refrigerant gas between the external refrigeration circuit 37 and the compressor.

Figure 4:
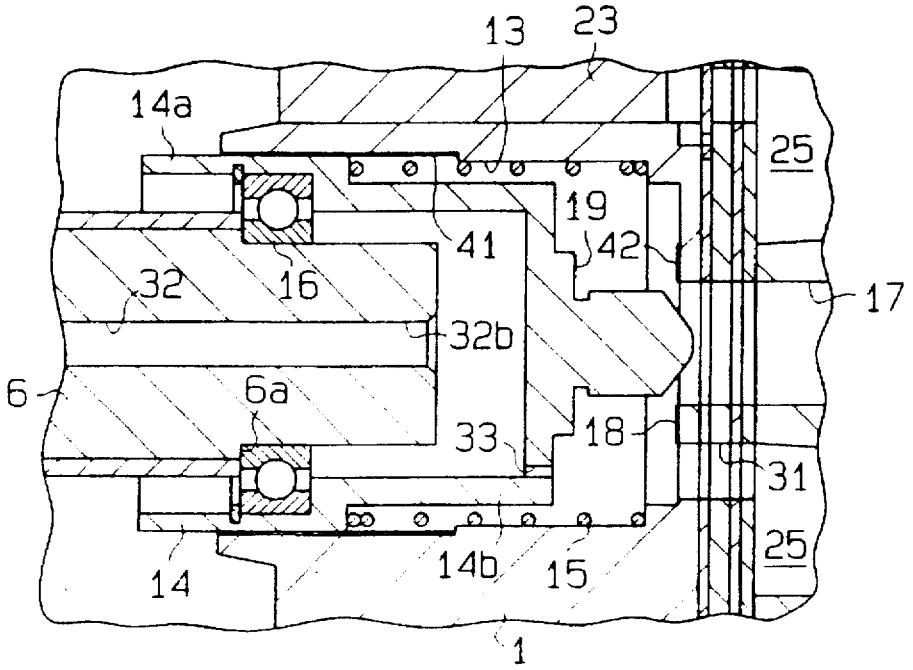
FIG. 4 is an enlarged partial cross-sectional view of the compressor according to a second embodiment of the present invention.
Figure 5:
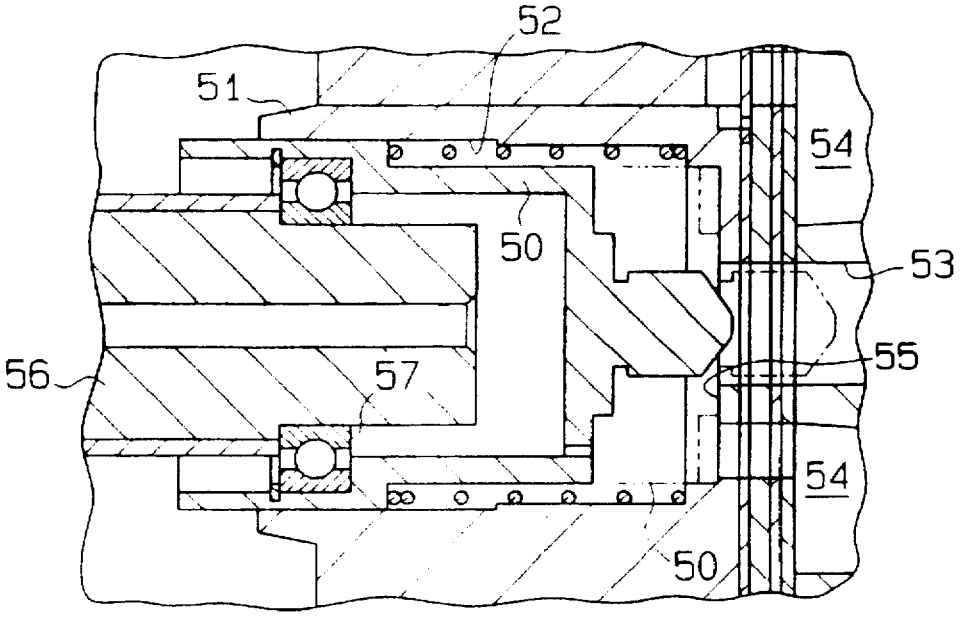
Fig.5 (Prior Art)
FIG. 5 is a partial cross-sectional view of a prior art compressor.

A second embodiment of the present invention will now be described with reference to FIG. 4. In the second embodiment, as shown in FIG. 4, a coating 41 is provided on the inner surface of the shutter chamber 13 instead of the outer circumferential surface of the spool 14. In addition, a coating 42 is provided on the positioning surface 18 instead of the shutter surface 19 of the spool 14. This structure achieves the same advantageous effects of the first embodiment.

Furthermore, the present invention may be modified as described below.

(1) In each of the above embodiments, resins such as FEP (copolymer of 4-ethylene fluoride and 6-propylene fluoride) and PTFE (polytetrafluoroethylene) may be used, instead of ETFE, as the fluororesin coatings 41 and 42.

(2) The coating 41 may be provided on both the outer surface of the spool 14 and the inner surface of the shutter chamber 13. The coating 42 may also be provided on both the shutter surface 19 of the spool 14 and the positioning surface 18. This structure reduces friction.

(3) A coating may be provided on the entire outer surface of the spool 14. This simplifies coating operations, in comparison with separate coatings applied on the large diameter portion 14*a* of the spool 14 and on the shutter surface 19.

(4) The coating 41 may be provided by attaching, for example, a cylindrical body made of FEP on the large diameter portion 14*a* of the spool 14 or fitting the cylindrical body into the inner surface of the shutter chamber 13. The coating 42 may also be provided by attaching an annular plate made of FEP on the shutter surface 19 or the positioning surface 18.

Therefore, the present examples and embodiments are to be considered as illustrative and not restrictive, and the invention is not to be limited to the details given herein, but may be modified within the scope of the appended claims.

What is claimed is:

1. A compressor having a housing body which includes a crank chamber, a suction chamber and a discharge chamber therein, a drive shaft rotatably supported within the housing body, a cylinder bore in said housing body, a swash plate mounted on the drive shaft in the crank chamber, and a piston slidable within said cylinder bore and coupled to the swash plate, wherein said swash plate converts rotation of the drive shaft to reciprocating movement of the piston in said cylinder bore to vary the capacity of the cylinder bore, said piston compressing a gas supplied to the cylinder bore from an external circuit separately provided from the compressor by way of the suction chamber and discharging the gas to the discharge chamber, wherein said swash plate is tiltable between a maximum inclined position and a minimum inclined position with respect to a plane perpendicular to the longitudinal axis of the drive shaft according to differential pressure between the crank chamber and the suction chamber, and wherein said swash plate controls displacement of the compressor based on the inclination thereof, said compressor comprising:

a spool movable between a first position and a second position in response to the maximum and minimum inclinations of the swash plate, said spool connecting the external circuit with the suction chamber in the first position and disconnecting the external circuit from the suction chamber in the second position;

said housing body having a slide surface engaged by the spool; and a coating layer provided on at least one of the spool and the slide surface to reduce frictional resistance occurring due to the sliding movement of the spool on the slide surface.

2. The compressor according to claim 1, wherein said coating layer is a fluororesin layer.

3. The compressor according to claim 2, wherein said fluororesin layer substantially consists of a copolymer of ethylene and tetrafluoroethylene, said layer having a thickness of 40–60 μm.

4. The compressor according to claim 3, wherein said layer is blast-painted on one of said spool and said slide surface.

5. The compressor according to claim 1 wherein said spool has an outer surface; and which further comprises:

a shutter chamber defined in the housing body and accommodating said spool, said shutter chamber having said slide surface contacting said outer surface of the spool, wherein said spool slides on the slide surface in an axial direction with respect to the drive shaft; and said coating layer is provided on at least one of said outer surface of the spool and said slide surface of the shutter chamber.

6. The compressor according to claim 1 wherein said spool has a hollow cylindrical shape; and which further comprises:

a bearing disposed within the spool to rotatably support the drive shaft.

7. The compressor according to claim 6 further comprising:

a transferring member movable along the axis of the drive shaft responsive to the inclination of the swash plate to impart said movement to the spool through said bearing.

8. The compressor according to claim 1 wherein said housing body further has a positioning surface adjacent to said external circuit;

said spool has an end surface which abuts against the positioning surface to be positioned in the second position; and said coating layer is provided on at least one of said end surface of the spool and said positioning surface.

9. The compressor according to claim 7, wherein said spool disconnects the external circuit from the suction chamber by the end surface which abuts against the positioning surface.

10. The compressor according to claim 9 wherein said shutter chamber communicates with the suction chamber; and which further comprises:

a suction passage for connecting said external circuit and said shutter chamber; and said positioning surface is disposed between the shutter chamber and the suction passage.

11. The compressor according to claim 1, wherein said coating layer is provided on both the spool and the slide surface.

12. The compressor according to claim 1, wherein said coating layer is provided on the spool.

13. The compressor according to claim 1, wherein said coating layer is provided on the slide surface.

14. A compressor having a housing body which includes a crank chamber, a suction chamber and a discharge chamber therein, a drive shaft rotatably supported in the housing body, a swash plate mounted on the drive shaft in the crank chamber, a cylinder bore within the housing body, and a piston slidable within said cylinder bore and coupled to the swash plate, wherein said swash plate converts rotation of the drive shaft to reciprocating movement of the piston in said cylinder bore to vary the capacity of the cylinder bore, said piston compressing a gas supplied to the cylinder bore from an external circuit separately provided from the compressor by way of the suction chamber and discharging the gas to the discharge chamber, wherein said swash plate is tiltable between a maximum inclined position and a minimum inclined position with respect to a plane perpendicular to the longitudinal axis of the drive shaft according to differential pressure between the crank chamber and the suction chamber, and wherein said swash plate controls displacement of the compressor based on the inclination thereof, said compressor comprising:

a hollow cylindrical shutter chamber defined in the housing body, said shutter chamber having an inner surface;

a spool accommodated in the shutter chamber, said spool having a cylindrical shape providing an outer surface contacting said inner surface of the shutter chamber, whereby said spool slides on said inner surface in an axial direction with respect to the drive shaft;

said spool being movable between a first position and a second position in response to the maximum and minimum inclinations of the swash plate, said spool connecting the external circuit with the suction chamber in the first position and disconnecting the external circuit from the suction chamber in the second position; and a first coating layer provided on at least one of said outer surface of the spool and said inner surface of the shutter chamber to reduce frictional resistance occurring due to the sliding movement of the spool on the inner surface.

15. The compressor according to claim 14, wherein said first coating layer is a fluororesin layer.

16. The compressor according to claim 15, wherein said fluororesin layer substantially consists of a copolymer of ethylene and tetrafluoroethylene, said layer having a thickness of 40–60 μm.

17. The compressor according to claim 15, wherein said external circuit opens into said shutter chamber via a suction passage opening;

said housing body has a positioning surface within said shutter chamber and along the periphery of said suction passage opening;

said spool has an end surface which abuts against the positioning surface when moved to its said second position; and a second coating layer is provided on at least one of said end surface of the spool and said positioning surface to seal and to reduce frictional resistance occurring due to rotation of the spool when contacting the positioning surface, said second coating layer being a fluororesin layer.

18. The compressor according to claim 17, wherein said second coating layer substantially consists of a copolymer of ethylene and tetrafluoroethylene, said layer having a thickness of 40–60 μm.

19. The compressor according to claim 17 further comprising:

said shutter chamber communicating with the suction chamber;

a suction passage for connecting said external circuit and said shutter chamber;

said positioning surface being disposed between the shutter chamber and the suction passage; and said spool disconnects the shutter chamber from the suction passage by the end surface which abuts against the positioning surface.

20. The compressor according to claim 19 further comprising a transferring member movable along the axis of the drive shaft responsive to the inclination of the swash plate to impart said movement to the spool through said bearing.

21. The compressor according to claim 17, wherein said second coating layer is provided on the end surface of the spool and on the positioning surface.

22. The compressor according to claim 17, wherein said second coating layer is provided on the end surface of the spool.

23. The compressor according to claim 17, wherein said second coating layer is provided on the positioning surface.

24. A compressor having a housing body which includes a crank chamber, a suction chamber and a discharge chamber therein, a drive shaft rotatably supported in the housing body, a swash plate mounted on the drive shaft within the crank chamber, a cylinder bore within said housing body, and a piston slidable within said cylinder bore and coupled to the swash plate, wherein said swash plate converts rotation of the drive shaft to reciprocating movement of the piston in said cylinder bore to vary the capacity of the cylinder bore, said piston compressing a gas supplied to the cylinder bore from an external circuit separately provided from the compressor by way of the suction chamber and discharging the gas to the discharge chamber, wherein said swash plate is tiltable between a maximum inclined position and a minimum inclined position with respect to a plane perpendicular to the longitudinal axis of the drive shaft according to differential pressure between the crank chamber and the suction chamber, and wherein said swash plate controls displacement of the compressor based on the inclination thereof, said compressor comprising:

a hollow cylindrical shutter chamber defined in the housing body, said shutter chamber having an inner surface;

a spool accommodated in the shutter chamber, said spool having a cylindrical shape providing an outer surface contacting said inner surface of the shutter chamber, whereby said spool slides on said inner surface in an axial direction with respect to the drive shaft;

said spool being movable between a first position and a second position in response to the maximum and minimum inclinations of the swash plate, said spool connecting the external circuit with the suction chamber in the first position and disconnecting the external circuit from the suction chamber in the second position; and a first fluororesin coating layer provided on at least one of said outer surface of the spool and said inner surface of the shutter chamber to reduce frictional resistance occurring due to the sliding movement of the member on the inner surface;

said housing body having a positioning surface within said shutter chamber and along the periphery of said suction chamber;

said spool having an end surface which abuts against the positioning surface when moved to its second position; and a second fluororesin coating layer provided on at least one of said end surface of the spool and said positioning surface to seal and to reduce frictional resistance occurring due to rotation of the spool when contacting the positioning surface.

25. The compressor according to claim 24, wherein said first fluororesin coating layer is provided on the outer surface of the spool and the inner surface of the shutter chamber; and said second fluororesin coating layer is provided on the end surface of the spool and on the positioning surface.

26. The compressor according to claim 24, wherein said first fluororesin coating layer is provided on the outer surface of the spool and the inner surface of the shutter chamber; and said second fluororesin coating layer is provided on the end surface of the spool.

27. The compressor according to claim 24, wherein said first fluororesin coating layer is provided on the outer surface of the spool and the inner surface of the shutter chamber; and said second fluororesin coating layer is provided on the positioning surface.

28. The compressor according to claim 24, wherein said first fluororesin coating layer is provided on the outer surface of the spool, and said second fluororesin coating layer is provided on the end surface of the spool and on the positioning surface.

29. The compressor according to claim 24, wherein said first fluororesin coating layer is provided on the inner surface of the shutter chamber, and said second fluororesin coating layer is provided on the end surface of the spool and on the positioning surface.

* * * * *